US009909591B2

(12) United States Patent
Tamaoka et al.

(10) Patent No.: US 9,909,591 B2
(45) Date of Patent: Mar. 6, 2018

(54) BLOWER FAN

(71) Applicant: NIDEC CORPORATION, Kyoto (JP)

(72) Inventors: Takehito Tamaoka, Kyoto (JP); Hiroaki Hirano, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 461 days.

(21) Appl. No.: 14/208,999

(22) Filed: Mar. 13, 2014

(65) Prior Publication Data

US 2015/0023814 A1 Jan. 22, 2015

(30) Foreign Application Priority Data

Jul. 18, 2013 (JP) ..... 2013-149868

(51) Int. Cl.
*F04D 25/06* (2006.01)
*F04D 25/08* (2006.01)
(Continued)

(52) U.S. Cl.
CPC ..... *F04D 25/0613* (2013.01); *F04D 19/002* (2013.01); *F04D 25/06* (2013.01);
(Continued)

(58) Field of Classification Search
CPC ..... G06F 1/203; F04D 25/06; F04D 25/0202; F04D 25/0613; F04D 25/062;
(Continued)

(56) References Cited

U.S. PATENT DOCUMENTS 4,164,690 A * 8/1979 Muller ..... F04D 25/0653 310/63
5,409,352 A * 4/1995 Lin ..... F04D 29/582 165/126
(Continued)

FOREIGN PATENT DOCUMENTS

CN 1460158 A 12/2003
CN 1821598 A 8/2006
(Continued)

OTHER PUBLICATIONS

Related to U.S. Appl. No. 14/209,524.
Related to U.S. Appl. No. 14/208,725.

*Primary Examiner* — Devon Kramer
*Assistant Examiner* — Thomas Cash
(74) *Attorney, Agent, or Firm* — Westerman, Hattori, Daniels & Adrian, LLP

(57) ABSTRACT

A stationary portion of a blower fan according to a preferred embodiment of the present invention includes a stator and a stator holding portion to which the stator is fixed. A rotating portion of the blower fan includes an annular rotor hub portion arranged around a central axis; a rotor magnet arranged along a circumferential surface of the rotor hub portion, and arranged radially inside a stator; and an impeller including a plurality of blades arranged along a circumferential direction of the rotor hub portion. An upper end of the stator is arranged at a level lower than that of an upper end of the rotor magnet. The impeller is arranged axially above
(Continued)

the rotor magnet and is arranged to extend radially outward. The blades are arranged axially above the stator.

10 Claims, 7 Drawing Sheets

(51) Int. Cl.
*F04D 19/00* (2006.01)
*F04D 29/057* (2006.01)
*F04D 29/063* (2006.01)

(52) U.S. Cl.
CPC ..... *F04D 25/062* (2013.01); *F04D 25/08* (2013.01); *F04D 25/082* (2013.01); *F04D 29/057* (2013.01); *F04D 29/063* (2013.01)

(58) Field of Classification Search
CPC .... F04D 25/0646; F04D 25/08; F04D 29/325; F04D 25/082
USPC ..... 361/694–695, 679.48–679.49, 361/679.55–679.56
See application file for complete search history.

(56) References Cited

U.S. PATENT DOCUMENTS 5,734,553 A * 3/1998 Hong ..... H01L 23/467 257/722
6,053,242 A * 4/2000 Hsieh ..... H01L 23/467 165/121
6,132,170 A * 10/2000 Horng ..... F04D 29/325 361/679.48
2003/0164653 A1 9/2003 Yasuda
2006/0188187 A1 8/2006 Kurimura et al.
2006/0227455 A1* 10/2006 Tamaoka ..... G11B 19/2009 360/99.08
2006/0238057 A1 10/2006 Tamaoka et al.
2007/0222331 A1* 9/2007 Horng ..... F04D 27/004 310/268
2008/0238230 A1* 10/2008 Mochida ..... H02K 1/2786 310/90.5
2009/0220360 A1 9/2009 Zhang et al.
2011/0058963 A1* 3/2011 Horng ..... F04D 25/0606 417/353

FOREIGN PATENT DOCUMENTS

CN 101520051 A 9/2009
CN 201368044 Y 12/2009
CN 202065212 U 12/2011
CN 102340208 A 2/2012
CN 202955001 U 5/2013
JP 06-296353 A 10/1994
JP 2001-241395 A 9/2001
JP 2002-227841 A 8/2002
JP 2006-226410 A 8/2006
JP 2006-325279 A 11/2006
JP 2009-203837 A 9/2009
JP 2013-130094 A 7/2013

* cited by examiner

BLOWER FAN

BACKGROUND OF THE INVENTION

1. Field of the Invention

The present invention relates to a blower fan of an inner-rotor type.

2. Description of the Related Art

In recent years, electronic devices, such as notebook personal computers and tablet personal computers, have been becoming thinner and thinner. In addition, such electronic devices have been becoming more and more sophisticated in functionality, causing a considerable increase in generation of heat in the electronic devices. Inside such slim electronic devices, a large number of electronic components are arranged, and a space occupied by an air is not large. Therefore, even in the case where components inside such an electronic devices do not generate much heat, a temperature inside the electronic device may quickly increase. Accordingly, it is necessary to cool an interior of the electronic device, and a blower fan is arranged inside the electronic device to cool the interior of the electronic device.

In a case of an electronic device which is not of a slim type, there is a large space in which electronic components are not arranged, and such an electronic device does not impose a heavy load on a blower fan installed therein. That is, an interior of the case is in a low static pressure environment. Therefore, even a blower fan which is inferior in a static pressure characteristic is able to send an air in a sufficient manner.

In contrast, in an electronic device of the slim type, only a small amount of air exists in a space in which no electronic components are arranged, and the electronic device of the slim type imposes a heavy load on a blower fan installed therein. That is, an interior of a case of the electronic device of the slim type is in a high static pressure environment. Therefore, the blower fan which is inferior in the static pressure characteristic is not able to send an air in a sufficient manner.

In this connection, JP-A 2009-203837 discloses the structure of a centrifugal fan in which an air outlet 21 is defined in a side wall of a casing 2 and is located in a direction in which an air is sent by an impeller 1, and in which air inlets 24 and 25 are defined in the side wall of the casing 2.

However, regarding the centrifugal fan disclosed in JP-A 2009-203837, a space from which an air can be sucked into the casing is required radially outside the side wall of the casing in a case of an electronic device in which the centrifugal fan is installed. It is not easy to provide a planar space in the case of the electronic device of the slim type, and since a large number of electronic components are arranged in such a planar space, it may be impossible to provide a sufficient space in the vicinity of the side wall of the casing of the centrifugal fan. In that case, installation of the centrifugal fan disclosed in JP-A 2009-203837 can neither achieve a sufficient air-blowing performance nor secure a sufficient amount of air to be discharged.

SUMMARY OF THE INVENTION

A blower fan according to a preferred embodiment of the present invention includes a stationary portion, a bearing mechanism, and a rotating portion arranged to rotate about a central axis extending in a vertical direction, and supported through the bearing mechanism to be rotatable with respect to the stationary portion. The stationary portion includes a stator and a stator holding portion to which the stator is fixed. The rotating portion includes an annular rotor hub portion arranged around the central axis; a rotor magnet arranged along a circumferential surface of the rotor hub portion, and arranged radially inside the stator; and an impeller including a plurality of blades arranged along a circumferential direction of the rotor hub portion. An upper end of the stator is arranged at a level lower than that of an upper end of the rotor magnet, the impeller is arranged axially above the rotor magnet and is arranged to extend radially outward, and the blades are arranged axially above the stator.

The present invention enables a blower fan of an inner-rotor type to achieve a high static pressure and a large air volume in terms of air-blowing performance.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
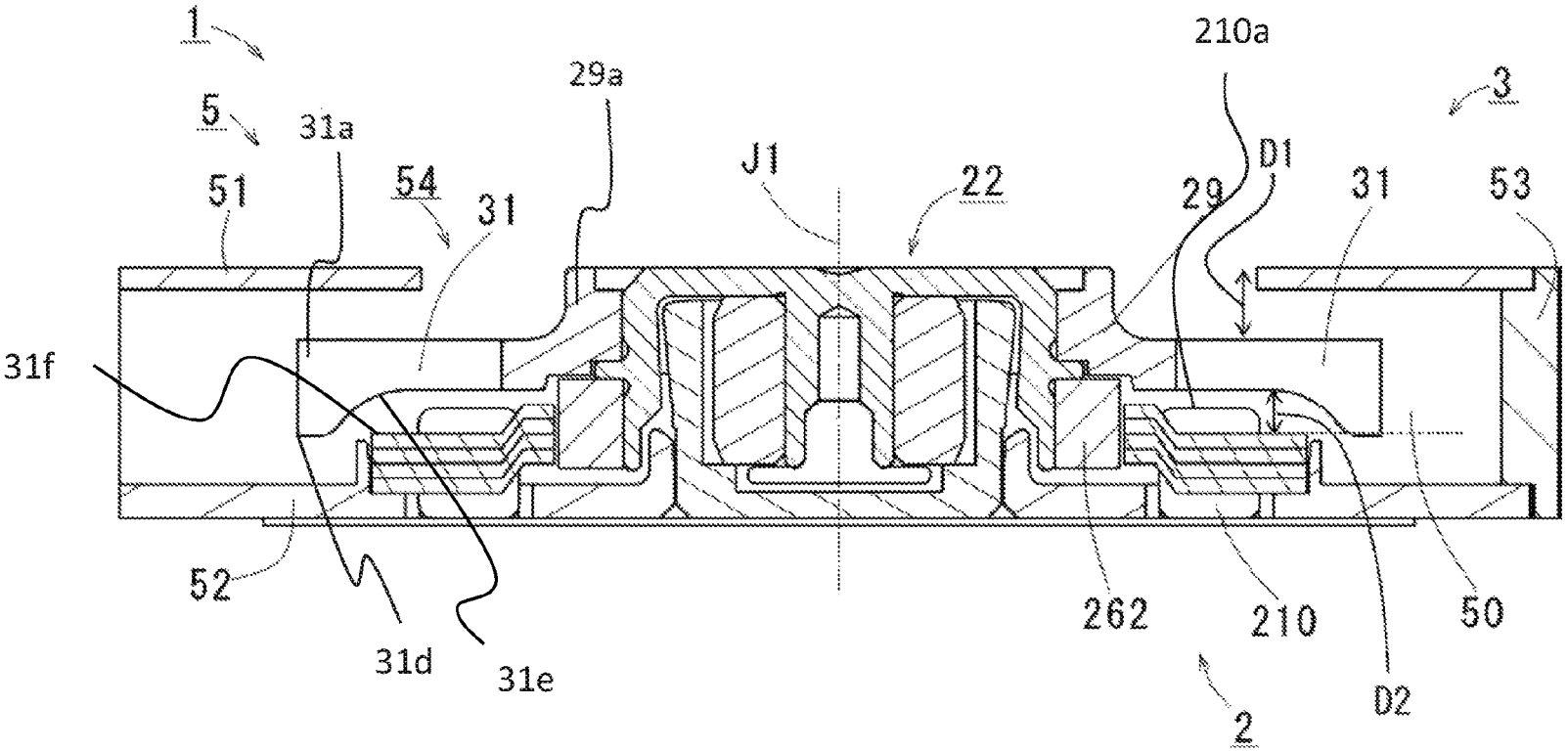
FIG. 1 is a cross-sectional view of a blower fan according to a first preferred embodiment of the present invention.

It is assumed herein that an upper side and a lower side in a direction parallel to a central axis J1 of a blower fan 1 illustrated in FIG. 1 are referred to simply as an upper side and a lower side, respectively. Note that a vertical direction assumed herein may not necessarily correspond with a vertical direction of the blower fan 1 when the blower fan 1 is actually installed in a device. It is also assumed herein that a circumferential direction about the central axis J1 is simply referred to by the term "circumferential direction", "circumferential", or "circumferentially", that radial directions centered on the central axis J1 are simply referred to by the term "radial direction", "radial", or "radially", and that the direction parallel to the central axis J1 is simply referred to by the term "axial direction", "axial", or "axially".

FIG. 1 is a vertical cross-sectional view of the blower fan 1 according to a first preferred embodiment of the present invention. The blower fan 1 is a centrifugal fan. The blower fan 1 is, for example, installed in a notebook personal computer, and is used to cool devices inside a case of the computer.

The blower fan 1 includes a motor portion 2, an impeller 3, and a housing 5. A central axis of the impeller 3 coincides with the central axis J1 of the motor portion 2. The impeller 3 includes a plurality of blades 31. The blades 31 are arranged in a circumferential direction about the central axis J1. The motor portion 2 is arranged to rotate the blades 31 about the central axis J1. The housing 5 is arranged to accommodate the motor portion 2 and the impeller 3.

The housing 5 includes an upper plate 51, a lower plate 52, and a side wall portion 53. The upper plate 51 is arranged to cover an upper side of the blades 31. The lower plate 52 is arranged to cover a lower side of the blades 31. The motor portion 2 is fixed to the lower plate 52. The side wall portion 53 is arranged to cover a lateral side of the blades 31. The upper plate 51, the side wall portion 53, and the lower plate 52 are arranged to together define an air channel portion 50 arranged to surround the impeller 3.

Each of the upper and lower plates 51 and 52 is made of a metal, such as an aluminum alloy or stainless steel, and is defined in the shape of a thin plate. The side wall portion 53 is made of an aluminum alloy, and is molded by die casting. Alternatively, the side wall portion 53 may be molded of a resin. A lower end portion of the side wall portion 53 and an edge portion of the lower plate 52 are joined to each other through screws or the like. The upper plate 51 is fixed to an upper end portion of the side wall portion 53 by crimping or the like. The upper plate 51 includes an air inlet 54. The air inlet 54 is located above the impeller 3. The upper plate 51, the side wall portion 53, and the lower plate 52 are arranged to together define an air outlet on a lateral side of the blades 31. Note that the lower plate 52 is arranged to define a portion of a stationary portion 21 of the motor portion 2. The stationary portion 21 will be described below.

In the motor portion 2 illustrated in FIG. 1, a current is supplied to a stator 210 to produce a torque centered on the central axis J1 between a rotor magnet 262 and the stator 210. This causes the blades 31 of the impeller 3 to rotate about the central axis J1 together with a rotating portion 22. Rotation of the impeller 3 caused by the motor portion 2 causes an air to be drawn into the housing 5 through the air inlet 54 and sent out through the air outlet.

Figure 2:
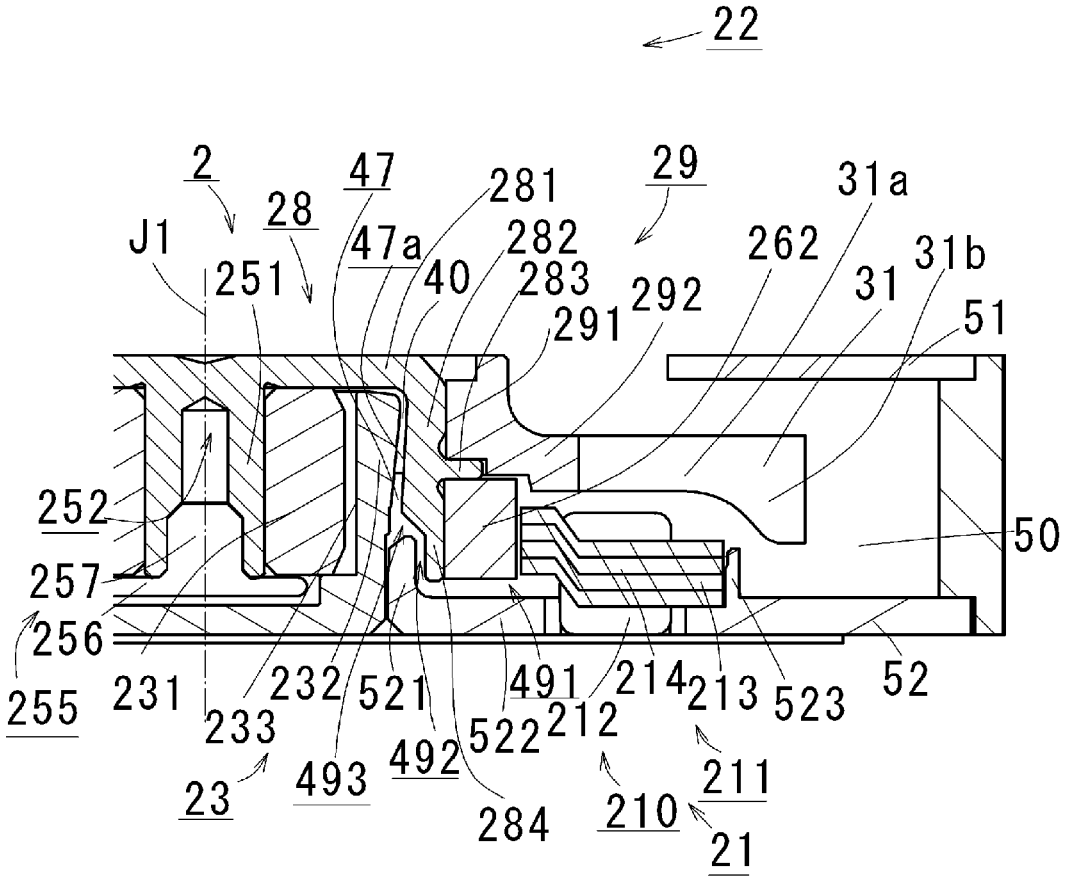
FIG. 2 is a cross-sectional view of a motor portion according to the first preferred embodiment and its vicinity.

FIG. 2 is a vertical cross-sectional view of the motor portion 2 and its vicinity. The motor portion 2 is of an inner-rotor type. The motor portion 2 includes the stationary portion 21, which is a stationary assembly, and the rotating portion 22, which is a rotating assembly. Since a bearing mechanism 4 is defined by a portion of the stationary portion 21 and a portion of the rotating portion 22 as described below, the motor portion 2 can be considered to include the stationary portion 21, the bearing mechanism 4, and the rotating portion 22 when the bearing mechanism 4 is regarded as a component of the motor portion 2. The rotating portion 22 is supported by the bearing mechanism 4 to be rotatable about the central axis J1 with respect to the stationary portion 21.

The stationary portion 21 includes the stator 210, a bearing portion 23, and the lower plate 52. The bearing portion 23 has a bottom and is substantially cylindrical and centered on the central axis J1. The bearing portion 23 includes a sleeve 231 and a sleeve housing 232. The sleeve 231 is substantially cylindrical and centered on the central axis J1. The sleeve 231 is a metallic sintered body. The sleeve 231 is impregnated with a lubricating oil 40. An improvement in flexibility in choosing a material of an inner circumferential portion of the bearing portion 23 is achieved by the bearing portion 23 being composed of two components. In addition, an increase in the amount of the lubricating oil 40 held in the bearing portion 23 is easily achieved by the sleeve 231 being a sintered body.

The sleeve housing 232 has a bottom and is substantially cylindrical and centered on the central axis J1. The sleeve housing 232 is arranged to cover an outer circumferential surface and a lower surface of the sleeve 231. The sleeve 231 is fixed to an inner circumferential surface of the sleeve housing 232 through an adhesive 233. The sleeve housing 232 is made of a resin. Preferably, both adhesion and press fit are used to fix the sleeve 231 and the sleeve housing 232 to each other. A radially inner portion of the lower surface of the sleeve 231 is spaced away from an inner bottom surface of the sleeve housing 232 in the vertical direction. The lower surface of the sleeve 231 and the inner circumferential surface and the inner bottom surface of the sleeve housing 232 are arranged to together define a plate accommodating portion 239.

The lower plate 52 includes a substantially circular through hole centered on the central axis J1. The lower plate 52 includes a bearing portion holding portion 521, a flat plate portion 522, and a stator holding portion 523. The bearing portion holding portion 521, the flat plate portion 522, and the stator holding portion 523 are preferably defined by a single continuous member. The bearing portion holding portion 521 is substantially cylindrical and centered on the central axis J1. The bearing portion holding portion 521 is arranged to extend axially upward from an inner end of the flat plate portion 522. The bearing portion holding portion 521 is arranged to hold the bearing portion 23 with an inner circumferential surface thereof. The inner circumferential surface of the bearing portion holding portion 521 is arranged to be in contact with an outer circumferential surface of the sleeve housing 232. The stator holding portion 523 is also substantially cylindrical and centered on the central axis J1. The stator holding portion 523 is arranged to project axially upward from the lower plate 52 radially outside the stator 210. The stator holding portion 523 includes an inner circumferential surface arranged to hold the stator 210.

A lower portion of the outer circumferential surface of the sleeve housing 232 is fixed to the inner circumferential surface of the bearing portion holding portion 521 through an adhesive. Note that both adhesion and press fit may be used to fix the sleeve housing 232 and the bearing portion holding portion 521 to each other.

The stator 210 is a substantially annular member centered on the central axis J1. The stator 210 is fixed to the inner circumferential surface of the stator holding portion 523 of the lower plate 52. The stator 210 includes a stator core 211 and a plurality of coils 212. The stator core 211 is defined by laminated silicon steel sheets each of which is in the shape of a thin plate. The stator core 211 includes a substantially annular core back 213 and a plurality of teeth 214 arranged to project radially inward from the core back 213. Each of the coils 212 is defined by a conducting wire wound around a separate one of the teeth 214.

The core back 213 is inserted in and adhered to the stator holding portion 523. An outer circumferential surface of the core back 213 is fixed to the inner circumferential surface of the stator holding portion 523. An upper end of the stator holding portion 523 is arranged at a level lower than that of an upper end of the core back 213. Slight press fit or press fit may be used to fix the core back 213 and the stator holding portion 523 to each other. An adhesive may also be used when press fitting the core back 213 and the stator holding portion 523 to each other. Both adhesion and press fit may be used to fix the core back 213 and the stator holding portion 523 to each other.

As described above, the lower plate 52 is arranged such that the air channel portion 50 is defined at an outer portion thereof, the bearing portion 23 is fixed to an inner portion thereof, and the stator 210 is fixed to an intermediate portion thereof. In the motor portion 2, both the stator 210 and the bearing portion 23 are directly fixed to the lower plate 52, which is a base portion.

The impeller 3 includes an impeller support portion 29 and the plurality of blades 31. The impeller support portion 29 includes an impeller cylindrical portion 291 and an impeller ring portion 292. Each blade 31 includes an inner blade portion 31*a* and an outer blade portion 31*b*. The impeller cylindrical portion 291, the impeller ring portion 292, and the blades 31 are preferably defined by a single continuous member.

The impeller ring portion 292 is arranged substantially in the shape of a disk and is centered on the central axis J1. The impeller ring portion 292 is arranged to extend radially outward from the impeller cylindrical portion 291. The impeller ring portion 292 is arranged to extend radially outward from a lower end of the impeller cylindrical portion 291. The impeller cylindrical portion 291 is arranged inside the impeller ring portion 292, and the impeller cylindrical portion 291 is arranged to extend axially upward therefrom. The blades 31, which are arranged in the circumferential direction with the central axis J1 as a center, are arranged outside the impeller ring portion 292. In other words, the blades 31 are joined to the impeller cylindrical portion 291 through the impeller ring portion 292.

The impeller cylindrical portion 291 is substantially cylindrical and centered on the central axis J1. The impeller cylindrical portion 291 is arranged to extend axially upward from an inner end of the impeller ring portion 292. An inner circumferential surface of the impeller cylindrical portion 291 is arranged opposite to an outer circumferential surface of a cylindrical seal portion 282. The lower end of the impeller cylindrical portion 291 is arranged opposite to a raised portion 283.

The inner circumferential surface of the impeller cylindrical portion 291 is fixed to the outer circumferential surface of the cylindrical seal portion 282. A rotor hub portion 28 is inserted in the impeller support portion 29. The rotor hub portion 28 and the impeller support portion 29 are fixed to each other through insertion and adhesion or through adhesion and press fit. The lower end of the impeller cylindrical portion 291 is arranged to be in contact with an upper surface of the raised portion 283. Note that the rotor hub portion 28 and the impeller 3 may be defined by a single continuous member.

An inner end portion of the inner blade portion 31*a* is joined to the impeller ring portion 292, while an outer portion of the inner blade portion 31*a* is defined integrally with the outer blade portion 31*b*. The inner end portion of the inner blade portion 31*a* is arranged radially inward of an outer circumference of the stator 210, while an outer end portion of the inner blade portion 31*a* is substantially arranged radially outward of the outer circumference of the stator 210. The impeller ring portion 292 has a function as a base portion of each blade 31. The inner end portion of the inner blade portion 31*a* is arranged above the stator 210. An upper end of the inner blade portion 31*a* is arranged to be flush with an upper end of the impeller ring portion 292. A strength with which each blade 31 is held is thereby sufficiently secured. The upper end of the inner blade portion 31*a* is arranged at a level higher than that of the upper surface of the raised portion 283 and that of an upper surface of the rotor magnet 262. A portion of the air inlet 54 is located over a portion of the inner blade portion 31*a*. A lower end of the inner blade portion 31*a* is arranged to be flush with a lower end of the impeller ring portion 292. The lower end of the inner blade portion 31*a* is arranged at a level lower than that of a lower surface of the raised portion 283 and that of the upper surface of the rotor magnet 262. The lower end of the inner blade portion 31*a* is arranged axially opposite an upper end of each coil 212.

An inner end portion of the outer blade portion 31*b* is joined to the inner blade portion 31*a*. The inner blade portion 31*a* and the outer blade portion 31*b* are joined to each other substantially in the vicinity of a point over the stator holding portion 523. The outer blade portion 31*b* is arranged to have an axial dimension greater than that of the inner blade portion 31*a*. An outer end of the outer blade portion 31*b* is arranged opposite to an inner wall of the side wall portion 53. An upper end of the outer blade portion 31*b* is arranged at the same level as that of the upper end of the inner blade portion 31*a*. The upper end of the outer blade portion 31*b* is arranged opposite to a lower surface of the upper plate 51. A lower end of the outer blade portion 31*b* is arranged at a level lower than that of the upper surface of the rotor magnet 262. The lower end of the outer blade portion 31*b* is arranged opposite to the lower plate 52.

A lower portion of the air channel portion 50 includes a space where an outer circumference of the stator holding portion 523 and an inner circumference of the side wall portion 53 are arranged opposite to each other, and where the lower end of the outer blade portion 31*b* of each blade 31 and the lower plate 52 are arranged opposite to each other.

The rotating portion 22 includes the rotor hub portion 28, a coming-off preventing portion 255, and the rotor magnet 262. The rotor hub portion 28 is supported by the bearing portion 23. The impeller 3 is held on an outer circumference of the rotor hub portion 28.

The rotor hub portion 28 includes a shaft 251, a bearing opposing portion 281, the cylindrical seal portion 282, the raised portion 283, and a magnet holding portion 284. The shaft 251, the bearing opposing portion 281, the cylindrical seal portion 282, the raised portion 283, and the magnet holding portion 284 are defined by a single continuous member. The rotor hub portion 28 is preferably defined by subjecting a metal to a cutting process.

The shaft 251 is substantially columnar and centered on the central axis J1. The shaft 251 is inserted in the sleeve 231 of the bearing portion 23. In other words, the sleeve 231 is arranged to surround the shaft 251 from radially outside. The shaft 251 is arranged to rotate about the central axis J1 relative to the bearing portion 23.

The coming-off preventing portion 255 is arranged at a lower portion of the shaft 251. The coming-off preventing portion 255 includes a plate portion 256 and a plate fixing portion 257. The plate portion 256 is substantially in the shape of a disk and arranged to extend radially outward from a lower end portion of the shaft 251. The plate portion 256 is arranged to have a diameter smaller than that of the lower surface of the sleeve 231. The plate fixing portion 257 is arranged to be recessed upward from an upper surface of the plate portion 256. An outer circumferential surface of the plate fixing portion 257 includes a male screw portion defined therein. The shaft 251 includes a hole portion 252 arranged to extend upward from a lower end thereof. An inner circumferential surface of the hole portion 252 includes a female screw portion defined therein. The plate fixing portion 257 is screwed into the hole portion 252, whereby the plate portion 256 is fixed to the lower end portion of the shaft 251.

Both the sleeve 231 and the plate portion 256 are arranged inside the sleeve housing 232. The plate portion 256 is accommodated in the aforementioned plate accommodating portion 239. The upper surface of the plate portion 256 is a substantially annular surface. The upper surface of the plate portion 256 is arranged opposite to the lower surface of the sleeve 231, that is, a downward facing surface in the plate accommodating portion 239, in the vertical direction, i.e., in the axial direction. The plate portion 256 and the sleeve 231 are arranged to together prevent the shaft 251 from coming off the bearing portion 23. A lower surface of the plate portion 256 is arranged axially opposite the inner bottom surface of the sleeve housing 232.

The bearing opposing portion 281 is arranged to extend radially outward from an upper end of the shaft 251. The bearing opposing portion 281 is substantially in the shape of an annular plate and centered on the central axis J1. The bearing opposing portion 281 is arranged above the bearing portion 23 and axially opposite the bearing portion 23. The cylindrical seal portion 282 is substantially cylindrical, and is arranged to extend downward from the bearing opposing portion 281. The cylindrical seal portion 282 is continuous with an outer periphery portion of the bearing opposing portion 281. The cylindrical seal portion 282 is arranged radially outward of the bearing portion 23 and radially inward of the rotor magnet 262. An inner circumferential surface of the cylindrical seal portion 282 is arranged radially opposite an upper portion of an outer circumferential surface of the bearing portion 23. A seal gap 47 is defined between the inner circumferential surface of the cylindrical seal portion 282 and the outer circumferential surface of the sleeve housing 232. A seal portion 47*a*, which has a surface of the lubricating oil 40 defined therein, is defined in the seal gap 47. The raised portion 283, which is arranged to project radially outward, is arranged in the outer circumferential surface of the cylindrical seal portion 282.

The magnet holding portion 284 is substantially cylindrical and is centered on the central axis J1. The magnet holding portion 284 is arranged to extend downward from the cylindrical seal portion 282. The rotor magnet 262 is substantially cylindrical and is centered on the central axis J1. The rotor magnet 262 is fixed to an outer circumferential surface of the magnet holding portion 284. The rotor magnet 262 is arranged radially inside the stator 210. An upper end of the stator 210 is arranged at a level lower than that of the upper end of the rotor magnet 262.

An upper surface of the flat plate portion 522 of the lower plate 52 and a lower end surface of the magnet holding portion 284 are arranged axially opposite each other. In addition, the upper surface of the flat plate portion 522 of the lower plate 52 and a lower end surface of the rotor magnet 262 are also arranged axially opposite each other. An annular minute horizontal gap 491 extending radially is defined between the upper surface of the flat plate portion 522 of the lower plate 52 and the lower end surface of the magnet holding portion 284 and between the upper surface of the flat plate portion 522 of the lower plate 52 and the lower end surface of the rotor magnet 262. In other words, both the magnet holding portion 284 and the rotor magnet 262 are arranged axially opposite the flat plate portion 522 of the lower plate 52 with the horizontal gap 491 intervening therebetween. The axial dimension of the horizontal gap 491 is preferably arranged to be in the range of about 0.1 mm to about 0.5 mm.

An annular minute vertical gap 492 extending in the axial direction is defined between an inner circumferential surface of the magnet holding portion 284 and an outer circumferential surface of the bearing portion holding portion 521. The vertical gap 492 is continuous with an inner circumferential portion of the horizontal gap 491, and is arranged to extend upward from the horizontal gap 491. The magnet holding portion 284 includes a slanting surface in an upper portion of the inner circumferential surface thereof, and an annular minute intermediate gap 493 is defined between the slanting surface and an upper end surface of the bearing portion holding portion 521. The intermediate gap 493 is continuous with an upper end portion of the vertical gap 492. In other words, the intermediate gap 493 is arranged to join the upper end portion of the vertical gap 492 and a lower end portion of the seal gap 47 to each other.

The horizontal gap 491, the vertical gap 492, and the intermediate gap 493 are arranged to together define a labyrinth structure radially outward of the seal gap 47. This contributes to preventing an air including the lubricating oil 40 evaporated from the seal gap 47 from traveling out of the bearing mechanism 4. As a result, a reduction in evaporation of the lubricating oil 40 out of the bearing mechanism 4 is achieved.

Referring to FIG. 1, the blades 31 are indirectly fixed to the outer circumferential surface of the cylindrical seal portion 282 through the impeller support portion 29. Note that the blades 31 may be directly fixed to the outer circumferential surface of the cylindrical seal portion 282 without any other member, such as the impeller support portion 29, intervening therebetween.

Figure 3:
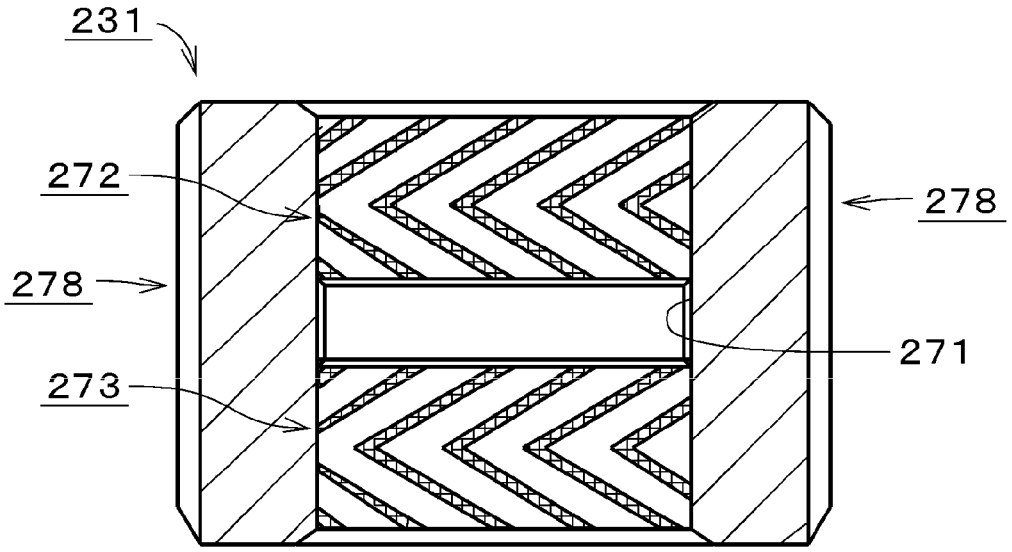
FIG. 3 is a cross-sectional view of a sleeve according to the first preferred embodiment.
Figure 4:
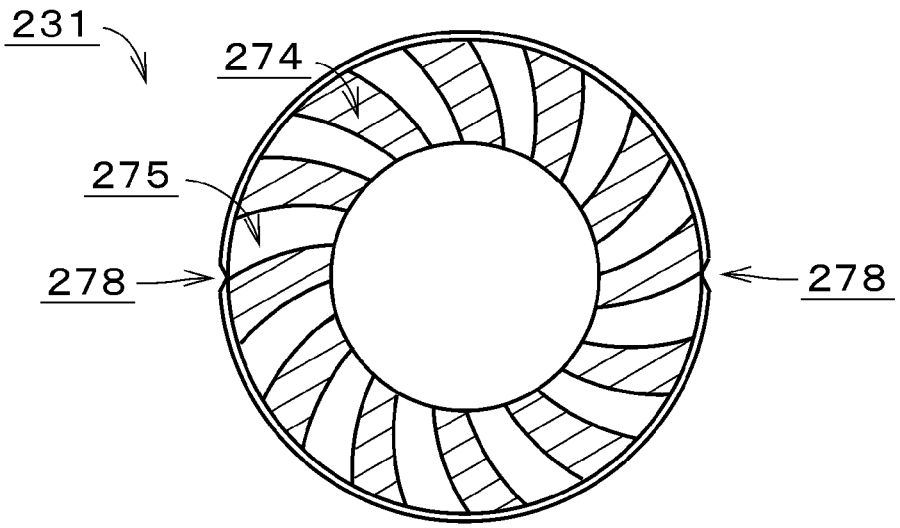
FIG. 4 is a plan view of the sleeve.
Figure 5:
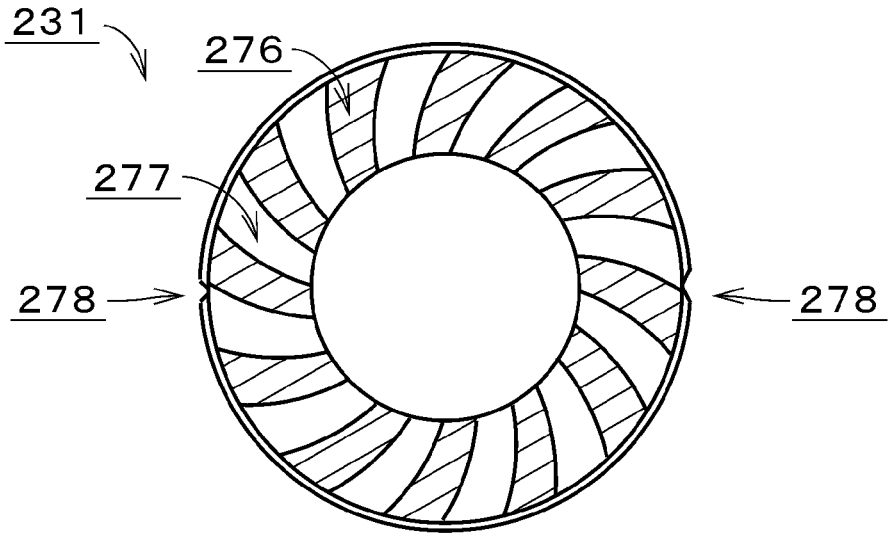
FIG. 5 is a bottom view of the sleeve.

FIG. 3 is a vertical cross-sectional view of the sleeve 231. An upper portion and a lower portion of an inner circumferential surface 271 of the sleeve 231 include a first radial dynamic pressure groove array 272 and a second radial dynamic pressure groove array 273, respectively. Each of the first and second radial dynamic pressure groove arrays 272 and 273 is made up of a plurality of grooves arranged in a herringbone pattern. FIG. 4 is a plan view of the sleeve 231. An upper surface 274 of the sleeve 231 includes a first thrust dynamic pressure groove array 275 made up of a plurality of grooves arranged in a spiral pattern. FIG. 5 is a bottom view of the sleeve 231. A lower surface 276 of the sleeve 231 includes a second thrust dynamic pressure groove array 277 arranged in a spiral pattern.

Note that each of the first and second radial dynamic pressure groove arrays 272 and 273 may be defined in an outer circumferential surface of the shaft 251. Also note that the first thrust dynamic pressure groove array 275 may be defined in a region of a lower surface of the bearing opposing portion 281 which is opposed to the upper surface 274 of the sleeve 231. Also note that the second thrust dynamic pressure groove array 277 may be defined in the upper surface of the plate portion 256. Also note that the first thrust dynamic pressure groove array 275 may be made up of a collection of grooves arranged in a herringbone pattern. Also note that the second thrust dynamic pressure groove array 277 may also be made up of a collection of grooves arranged in a herringbone pattern.

Figure 6:
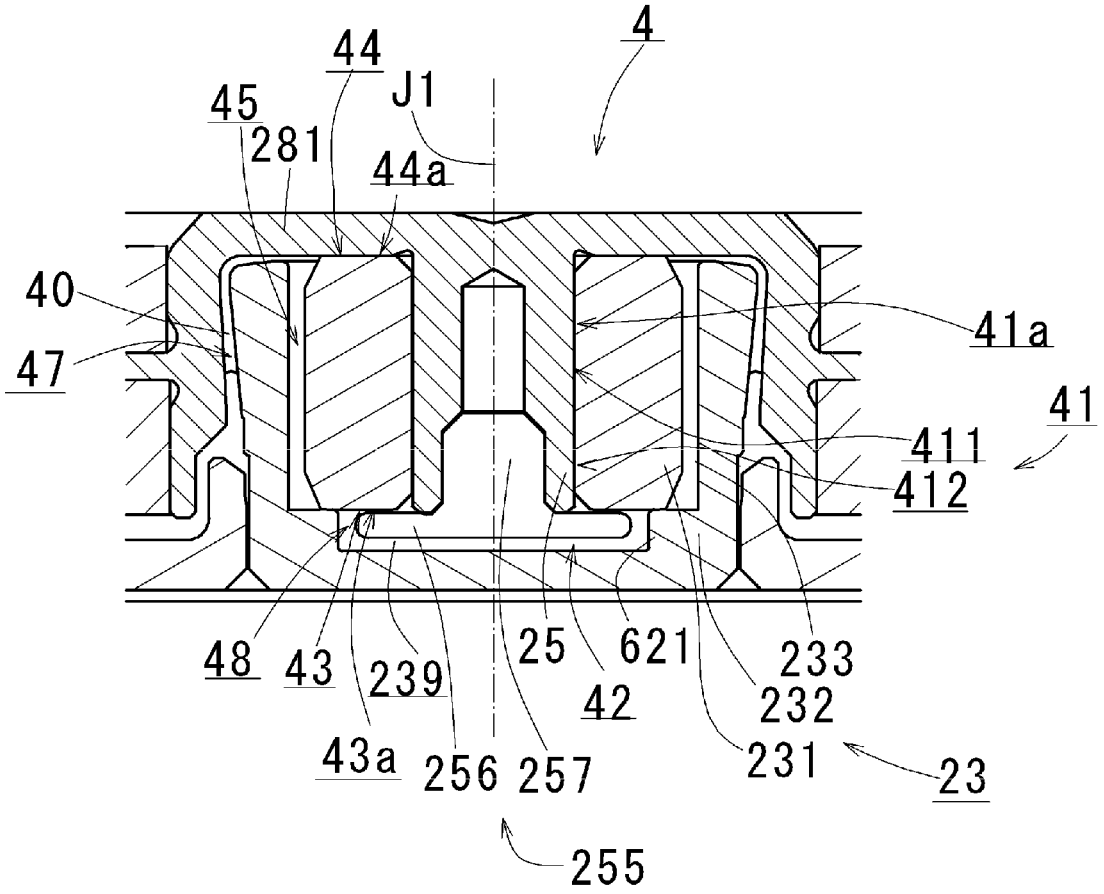
FIG. 6 is a cross-sectional view of a bearing portion according to the first preferred embodiment and its vicinity.

FIG. 6 is a vertical cross-sectional view of the bearing portion 23 and its vicinity. A lower gap 42 is defined between the plate portion 256 and the sleeve housing 232. The lubricating oil 40 is arranged in the lower gap 42. A plate surrounding space 48 is defined between a side surface of the plate portion 256 and an inside surface of a bottom portion of the sleeve housing 232. The lubricating oil 40 exists in the plate surrounding space 48. A second thrust gap 43 is defined between the lower surface of the sleeve 231 and the upper surface of the plate portion 256. The lubricating oil 40 is arranged in the second thrust gap 43. The second thrust gap 43 is arranged to define a second thrust dynamic pressure bearing portion 43*a* arranged to generate a fluid dynamic pressure in the lubricating oil 40. The plate surrounding space 48 enables the lubricating oil 40 to exist continuously from an outer circumferential portion of the second thrust gap 43 to an outer circumferential portion of the lower gap 42.

A radial gap 41 is defined between the outer circumferential surface of the shaft 251 and the inner circumferential surface of the sleeve 231. A lower end portion of the radial gap 41 is continuous with an inner circumferential portion of the second thrust gap 43. The radial gap 41 includes a first radial gap 411 and a second radial gap 412 arranged below the first radial gap 411.

The first radial gap 411 is defined between the outer circumferential surface of the shaft 251 and a portion of the inner circumferential surface of the sleeve 231 in which the first radial dynamic pressure groove array 272 illustrated in FIG. 3 is defined. Meanwhile, the second radial gap 412 is defined between the outer circumferential surface of the shaft 251 and a portion of the inner circumferential surface of the sleeve 231 in which the second radial dynamic pressure groove array 273 is defined. The lubricating oil 40 is arranged in the radial gap 41. The first and second radial gaps 411 and 412 are arranged to together define a radial dynamic pressure bearing portion 41*a* arranged to generate a fluid dynamic pressure in the lubricating oil 40. The shaft 251 is radially supported by the radial dynamic pressure bearing portion 41*a*.

A first thrust gap 44 is defined between an upper surface of the bearing portion 23 and the lower surface of the bearing opposing portion 281. The first thrust gap 44 is arranged to extend radially outward from an upper end portion of the radial gap 41. The lubricating oil 40 is arranged in the first thrust gap 44. A first thrust dynamic pressure bearing portion 44*a* arranged to generate a fluid dynamic pressure in the lubricating oil 40 is defined in a region of the first thrust gap 44 in which the first thrust dynamic pressure groove array 275 illustrated in FIG. 4 is defined. That is, a gap defined between the upper surface 274 of the sleeve 231 and the lower surface of the bearing opposing portion 281 is arranged to define the first thrust dynamic pressure bearing portion 44*a* arranged to generate the fluid dynamic pressure in the lubricating oil 40.

The bearing opposing portion 281 is axially supported by both the first and second thrust dynamic pressure bearing portions 44*a* and 43*a*. Provision of the first and second thrust dynamic pressure bearing portions 44*a* and 43*a* contributes to reducing a variation in axial play of the shaft 251. The aforementioned seal gap 47 is arranged to extend downward from an outer circumferential portion of the first thrust gap 44.

Circulation channels 45 are defined between the outer circumferential surface of the sleeve 231 and the inner circumferential surface of the sleeve housing 232. Each circulation channel 45 is arranged to cause an outer circumferential portion of the first thrust dynamic pressure bearing portion 44*a* and an outer circumferential portion of the second thrust dynamic pressure bearing portion 43*a* to be in communication with each other.

In the motor portion 2, the seal gap 47, the first thrust gap 44, the radial gap 41, the second thrust gap 43, the plate surrounding space 48, the lower gap 42, and the circulation channels 45 are arranged to together define a single continuous bladder structure, and the lubricating oil 40 is arranged continuously in this bladder structure. Within the bladder structure, the surface of the lubricating oil 40 is defined only in the seal gap 47, which is located between the inner circumferential surface of the cylindrical seal portion 282 and the outer circumferential surface of the bearing portion 23. The bladder structure contributes to easily preventing a leakage of the lubricating oil 40.

The bearing mechanism 4 of the motor portion 2 includes the shaft 251, the sleeve 231, the sleeve housing 232, the adhesive 233, the plate portion 256, the bearing opposing portion 281, the cylindrical seal portion 282, and the aforementioned lubricating oil 40. In the bearing mechanism 4, the shaft 251, the plate portion 256, the bearing opposing portion 281, and the cylindrical seal portion 282 are arranged to rotate about the central axis J1 relative to the bearing portion 23 through the lubricating oil 40.

Regarding the blower fan 1, in the case where the rotor hub portion 28 is defined by subjecting the metal to the cutting process, precision with which the rotor hub portion 28 is shaped is improved. This enables each of the radial dynamic pressure bearing portion 41*a*, the first thrust dynamic pressure bearing portion 44*a*, the second thrust dynamic pressure bearing portion 43*a*, and the seal gap 47 to be defined with high precision.

Figure 7:
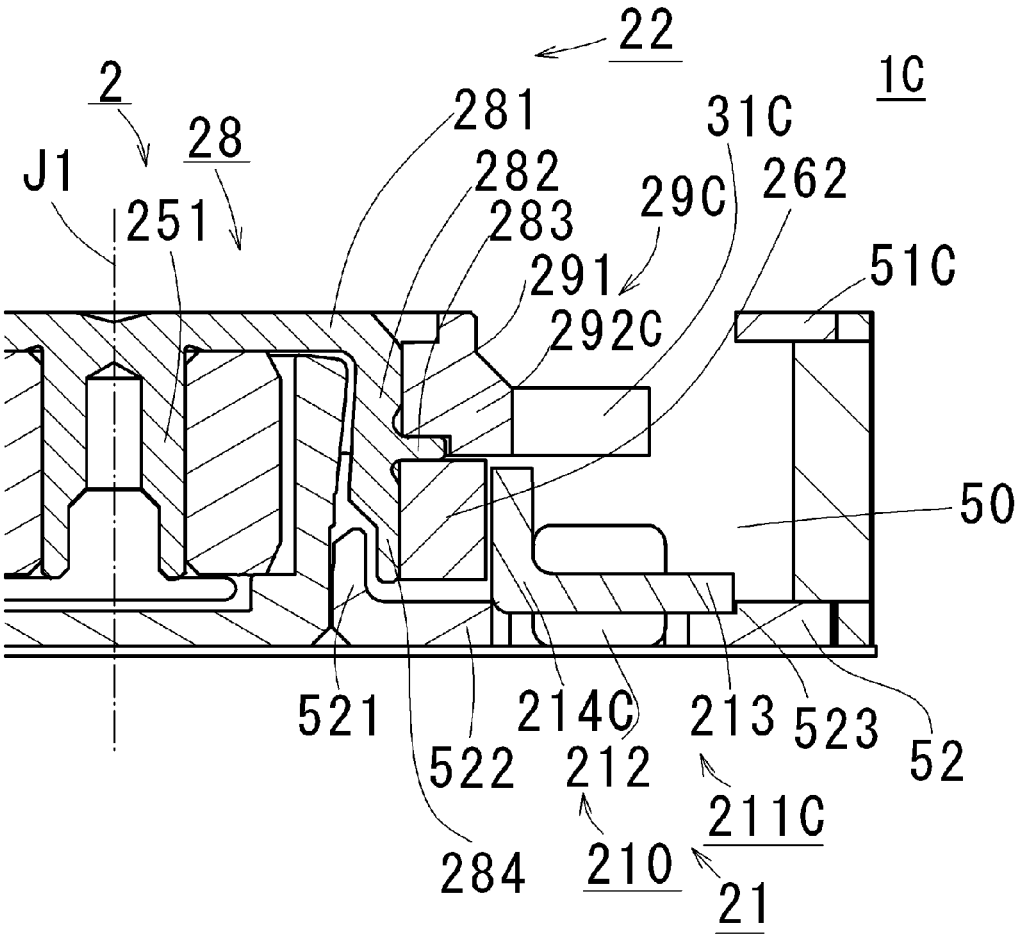
FIG. 7 is a cross-sectional view of a motor portion according to a second preferred embodiment of the present invention and its vicinity.

FIG. 7 is a cross-sectional view of a motor portion 2 according to a second preferred embodiment of the present invention and its vicinity. A blower fan 1C illustrated in FIG. 7 has a size even smaller than that of the blower fan 1 according to the first preferred embodiment. In an impeller 3 of the blower fan 1C, a radially outer edge of each of blades 31C is arranged radially inward of an outer circumferential surface of a stator 210. An impeller support portion 29C includes an impeller cylindrical portion 291 and an impeller ring portion 292C. A lower end of the impeller ring portion 292C is arranged at a level higher than that of a lower surface of a raised portion 283. A lower surface of the impeller ring portion 292C is arranged opposite to an upper surface of a rotor magnet 262 with a gap intervening therebetween. An upper surface of the impeller ring portion 292C includes a slanting surface continuous with the impeller cylindrical portion 291.

The blades 31C are arranged above the stator 210. An inner end of each blade 31C is arranged axially opposite a tip portion of a tooth 214C described below. An outer end of the blade 31C is arranged radially inward of the outer circumferential surface of the stator 210. The outer end of the blade 31C is substantially arranged axially opposite an outer end portion of a coil 212. The above arrangements allow an upper outer end of the stator 210 to be exposed to an air channel portion 50 to enable cooling of the stator 210. In addition, the outer end of each blade 31C is arranged radially inward of an inner edge of an upper plate 51C. In other words, it is possible to view the outer end of the blade 31C through an air inlet 54 in a plan view. A lower end of the blade 31C is arranged to be flush with the lower end of the impeller ring portion 292C. The lower end of the blade 31C is arranged at a level higher than that of the lower surface of the raised portion 283 and that of the upper surface of the rotor magnet 262.

A stator core 211C is defined by a silicon steel sheet in the shape of a thin plate. The stator core 211C includes a substantially annular core back 213 and a plurality of teeth 214C arranged to project radially inward from the core back 213. The tip portion of each tooth 214C is bent axially upward, and an inner surface of the bent tip portion of the tooth 214C is arranged radially opposite an outer circumferential surface of the rotor magnet 262. An upper end of the tip portion of the tooth 214C is arranged opposite to the impeller 3. Although the stator core 211C according to the present preferred embodiment is assumed to be defined by a single silicon steel sheet, the stator core 211C may be defined by laminated silicon steel sheets, with only one of the silicon steel sheets being bent.

The core back 213 is inserted in a stator holding portion 523. The stator holding portion according to the present preferred embodiment, which is arranged to hold the stator 210, is not arranged to project upward, but is defined by a recessed portion defined in a lower plate 52. The motor portion 2 according to the second preferred embodiment is otherwise similar in structure to the motor portion 2 illustrated in FIG. 2.

The blower fan 1 according to the above-described first preferred embodiment includes the rotating portion 22 arranged to rotate about the central axis J1 extending in the axial direction. The blower fan 1 includes the stationary portion 21, the bearing mechanism 4, and the rotating portion 22, which is supported through the bearing mechanism 4 to be rotatable with respect to the stationary portion 21. The stationary portion 21 includes the stator 210 and the stator holding portion 523, to which the stator 210 is fixed. The rotating portion 22 includes the annular rotor hub portion 28 arranged around the central axis J1, the rotor magnet 262, which is arranged along a circumferential surface of the rotor hub portion 28 and is arranged radially inside the stator 210, and the impeller 3 including the blades 31 arranged along a circumferential direction of the rotor hub portion 28. The upper end of the stator 210 is arranged at a level lower than that of an upper end of the rotor magnet 262. The impeller 3 is arranged axially above the rotor magnet 262, and is arranged to extend radially outward. The blades 31 are arranged axially above the stator 210.

The above-described arrangements of the above-described first preferred embodiment make it possible to secure a sufficient axial distance between the lower end of each blade 31 and the upper end of the stator 210. Moreover, a sufficient axial dimension of each blade 31 can be secured while preventing the blade 31 from interfering with the stator 210. A sufficient air volume can thereby be secured.

Furthermore, in the case where the housing 5 is provided, the above-described arrangements make it possible to secure a sufficient axial distance between the upper plate 51 and each blade 31. In addition, the above-described arrangements make it possible to arrange the blades 31 at a relatively low level for the axial height of the entire blower fan 1 while securing a sufficient distance between the stator 210 and each blade 31. In the case where a large proportion of a space inside a case of an electronic device is occupied by electronic components (i.e., in the case where the electronic device is a slim electronic device), a sufficient space is not secured above the air inlet 54 of the blower fan 1, and efficiency with which an air is sucked is extremely low. Adoption of the structure of the blower fan 1 described above makes it possible to secure a sufficient distance between the upper plate 51 and each blade, and to secure a space in which an air to be sent into the blades 31 can stay. This enables the blower fan 1 to have an excellent air volume characteristic.

An air sucked into the blower fan 1 enters into an interior of the blower fan 1 through the air inlet 54, and passes through a space between the upper plate 51 and the stator 210 to reach the air channel portion 50. Here, the axial distance between the lower surface of the upper plate 51 and the upper end of the stator 210 is shorter than the axial distance between the lower surface of the upper plate 51 and the upper surface of the lower plate 52. Therefore, the speed of an air passing above the stator 210 is increased according to the Bernoulli's principle. When the air attempts to flow backward, the air needs to pass above the stator 210 to reach the air inlet 54. That is, the air needs to flow backward in a region where the speed of air flow is high, and this makes it difficult for the air to flow backward. In other words, the blower fan 1 having the above-described structure has an excellent static pressure characteristic.

In the blower fan 1 according to the above-described first preferred embodiment, the rotor hub portion 28 and the impeller 3 are defined by separate members. The rotor hub portion 28 includes an outer circumferential surface arranged to hold the rotor magnet 262, and the raised portion 283, which is arranged to project radially outward from the outer circumferential surface of the rotor hub portion 28. The lower surface of the raised portion 283 is arranged to be in contact with the rotor magnet 262. The lower end of each blade 31 is arranged at a level lower than that of the upper surface of the raised portion 283.

The above arrangements of the above-described first preferred embodiment enable the lower end of each blade 31 to be lowered. Lowering of the lower end of the blade 31 makes it possible to secure a sufficient axial dimension of the blade 31. This makes it possible to secure a sufficient air volume.

In the blower fan 1 according to the above-described first preferred embodiment, the stator holding portion 523 includes a projecting portion arranged to project axially upward radially outside the stator 210. The stator 210 is held by an inner surface of the projecting portion, and the projecting portion is arranged at a level lower than that of an uppermost end of the stator 210.

The above arrangements of the above-described first preferred embodiment enable the air channel portion 50 extending in the circumferential direction to be defined radially outward of the projecting portion of the stator holding portion 523. This reduces a hindrance to a flow of an air when the air is allowed to flow, and enables the air to be smoothly discharged to an outside. In addition, it is made possible to lower the position of the upper end of each blade 31.

In the blower fan 1 according to the above-described first preferred embodiment, an outer end of the raised portion 283 is arranged radially inward of the outer circumferential surface of the rotor magnet 262. The impeller 3 is located radially outside the raised portion 283 and axially above the rotor magnet 262.

The blower fan 1 according to the above-described first preferred embodiment further includes the housing 5 arranged to accommodate the stationary portion 21, the bearing mechanism 4, and the rotating portion 22. The housing 5 includes the lower plate 52, which is arranged to cover a lower side of the impeller 3 and which includes the stator holding portion 523, and the side wall portion 53 arranged to cover a lateral side of the impeller 3. The lower plate 52 or the upper plate 51, which is arranged to cover an upper side of the impeller 3, includes the air inlet 54. The air channel portion 50, which is arranged to surround the impeller 3, is defined by the upper plate 51, the side wall portion 53, and the lower plate 52. The upper plate 51, the side wall portion 53, and the lower plate 52 are arranged to together define the air outlet on the lateral side of the impeller 3. The axial distance D1 between an upper end edge of the air inlet 54 and the upper end of each blade 31 is arranged to be longer than the axial distance D2 between the lower end of the blade 31 and the stator 210. The above arrangements of the above-described first preferred embodiment lead to an increase in the amount of air sucked in and an increase in the air volume. The blower fan has an upper plate 51 having an air inlet, the upper plate arranged to cover an upper side of the circumferential edge portion 31*a* of the impeller. The base portion 29*a* is exposed though the air inlet 54.

In the blower fan 1 according to the above-described first preferred embodiment, at least a portion of the stator 210 is arranged radially outward of all of the rotor hub portion 28 and a base portion of each blade 31. An axial gap between the stator 210 and axially lower edges of the blades 31 is, at the same radial position as that of the axial gap, joined to a space axially above axially upper edges of the blades 31 through spaces defined circumferentially between the blades 31. The axially lower edges 34*e* of the blades 31 are, at any radial position, opposed to upper surfaces of the coils over an entire circumferential extent 31*f* with only the axial gap and no other object intervening therebetween.

The above arrangements of the above-described first preferred embodiment enable an air axially sucked into the blower fan 1 to directly impinge on the stator 210. The air is thereafter discharged radially outward by the blades 31. This action makes it possible to forcibly cool the stator 210. This makes it possible to rotate the blower fan 1 at a higher speed. In addition, in the case where the blower fan 1 is used under a high temperature environment, an increase in temperature of the stator 210 can be reduced.

The stator 210 of the blower fan 1 according to the above-described first preferred embodiment includes the annular core back 213, the plurality of teeth 214 arranged to extend radially inward from the core back 213, and the coils 212 wound on the teeth 214. An inner circumferential surface of the core back 213 is arranged radially outward of all of the base portions of the blades 31 and the rotor hub portion 28. The above arrangements of the above-described first preferred embodiment make it possible to cool the entire core back 213.

In the blower fan 1 according to the above-described first preferred embodiment, a radially outer edge (not shown) of each coil 212 is arranged radially outward of all of the base portions of the blades 31 and the rotor hub portion 28.

The above arrangement of the above-described first preferred embodiment makes it possible to directly cool the coils 212. The ability to directly cool the coils 212 leads to an increased life of the motor. The air sucked into the blower fan 1 according to the above-described first preferred embodiment passes the blades 31 in the axial direction, and further passes between the coils 212. Therefore, adoption of the above arrangement achieves an increase in cooling efficiency compared to the case where the air flows only above the coils 212 or only below the coils 212. However, an air volume characteristic is deteriorated because of flow channels between the coils 212, and also noise is increased. However, an air which has once entered into any gap between the coils 212 returns upward after a short lapse of time. That is, an air which has passed between the coils 212 is not discharged to the outside through another channel. In other words, a decrease in air volume is not very large.

In the blower fan 1C according to the above-described second preferred embodiment, the radially outer edge of each blade 31C is arranged radially inward of the outer circumferential surface of the stator 210.

The above arrangement of the above-described second preferred embodiment causes the stator 210 to be exposed to a channel for an air sent from the blades 31C, and this leads to more effective cooling of the stator 210. In general, a wind sent from the blades 31C has both radial and axial components. Therefore, the air is sent toward the core back 213. This results in increased efficiency in cooling of the stator 210.

In the blower fan 1 according to the above-described first preferred embodiment, the radially outer edge of each blade 31 is arranged radially outward of the stator 210. The stationary portion 21 includes an outside gap arranged radially outside the stator 210 to surround the stator 210. Each blade 31 includes the outer blade portion 31*b* arranged to project axially downward radially outside the stator 210.

In an area where each blade 31 overlaps with the stator 210, an attempt to increase the height of the blade 31 necessitates an upward extension of the blade 31. However, the above-described arrangement of the above-described first preferred embodiment enables a downward extension of the blade 31 radially outside the stator 210, making it possible to secure a sufficient height of the blade 31. Improvements in the air volume characteristic and the static pressure characteristic are thereby achieved. In addition, an air current caused by the outer blade portion 31*b* of the blade 31 tends to pass above the stator 210, and this leads to an additional improvement in the cooling efficiency.

In the blower fan 1 according to the above-described first preferred embodiment, the lower end 31*d* of the outer blade portion 31*b* is arranged at a level lower than that of the upper end 210*a* of the stator 210.

In the blower fan 1 according to the above-described first preferred embodiment, at least a portion of the outer circumferential surface of the stator 210 is exposed.

The above arrangement of the above-described first preferred embodiment allows the outer circumferential surface of the stator 210 to define a portion of the air channel portion, and this allows an air to be in continuous touch with the outer circumferential surface of the stator 210. An improvement in a cooling characteristic is thereby achieved.

In the blower fan 1 according to the above-described first preferred embodiment, the stator 210 includes a molding resin arranged between adjacent ones of the coils 212.

The above arrangement of the above-described first preferred embodiment causes an air about to pass between the coils 212 to make contact with an upper surface of the molding resin and speedily flow out of the stator 210. This makes it possible to improve an ability to cool the stator 210 without deteriorating the air volume characteristic.

The structures of the bearing mechanism 4 and the blower fans 1 and 1C described above may be modified in a variety of manners.

For example, a material of any member of the impeller 3, the bearing mechanism 4, or the housing 5 may be changed appropriately. For example, the sleeve 231 may not necessarily be made of a sintered metal. The sleeve housing 232 may be made of a metal. For example, the sleeve housing 232 may be made of aluminum or the like, and be molded by die casting. The impeller 3 may also be made of a metal.

In the motor portion 2 illustrated in FIG. 1, both the stator 210 and the bearing portion 23 are directly fixed to the lower plate 52, which is the base portion. Note, however, that a member such as a bushing may be arranged to intervene between the lower plate 52 and at least one of the stator 210 and the bearing portion 23, so that the at least one of the stator 210 and the bearing portion 23 is indirectly fixed to the lower plate 52.

The first thrust dynamic pressure groove array 275 may be defined in an upper surface of the sleeve housing 232, or in a region opposed to the upper surface of the sleeve housing 232 in the lower surface of the bearing opposing portion 281. In other words, the first thrust dynamic pressure groove array 275 is defined in at least one of the upper surface of the bearing portion 23 and the lower surface of the bearing opposing portion 281. As a result, the first thrust dynamic pressure bearing portion 44*a* is defined between the upper surface of the bearing portion 23 and the lower surface of the bearing opposing portion 281.

The second thrust dynamic pressure bearing portion 43*a* may be omitted. In this case, the plate portion 256 only functions as a portion to prevent the shaft 251 from coming off the bearing portion 23. The first thrust dynamic pressure bearing portion 44*a* may also be omitted.

Each of the first and second radial dynamic pressure groove arrays 272 and 273 may be omitted.

In the bearing mechanism 4 illustrated in FIG. 2, the lubricating oil 40 is arranged to exist continuously in a gap between a portion including the sleeve 231 and the sleeve housing 232 and a portion including the shaft 251 and the plate portion 256. In the case where the lubricating oil 40 is arranged to circulate as in the bearing mechanism 4 illustrated in FIG. 2, the lubricating oil 40 is arranged to exist continuously from the plate surrounding space 48, which is a space surrounding the plate portion 256, to the radial dynamic pressure bearing portion 41*a* through each circulation channel 45 and the upper surface of the sleeve 231, and then to exist continuously from the radial dynamic pressure bearing portion 41*a* to the plate surrounding space 48 through the lower surface of the sleeve 231. Ribs or grooves may be defined in the outer circumferential surface of the sleeve 231 in place of the circulation channels 45.

A blower fan in which the bearing mechanism 4 is provided may be an axial fan. The bearing mechanism 4 may be used in a motor used for another purpose.

Features of the above-described preferred embodiments and the modifications thereof may be combined appropriately as long as no conflict arises.

Blower fans according to preferred embodiments of the present invention are usable to cool devices inside cases of notebook PCs and desktop PCs, to cool other devices, to supply an air to a variety of objects, and so on. Moreover, blower fans according to preferred embodiments of the present invention are also usable for other purposes.

What is claimed is:

1. A blower fan comprising:

a stationary portion;

a bearing mechanism; and a rotating portion arranged to rotate about a central axis extending in a vertical direction, and supported through the bearing mechanism to be rotatable with respect to the stationary portion; and a housing arranged to accommodate the stationary portion, the bearing mechanism, and the rotating portion, wherein the stationary portion includes:

a stator; and a stator holding portion to which the stator is fixed;

the rotating portion includes:

an annular rotor hub portion arranged around the central axis;

a rotor magnet arranged along a circumferential surface of the rotor hub portion, and arranged radially inside the stator; and an impeller including a plurality of blades arranged along a circumferential direction of the rotor hub portion, each of said plurality of blades having a base portion attached to the rotor hub portion and a circumferential edge portion, each of said plurality of blades extending in a radial direction from the base portion to the circumferential edge portion beyond the stator such that the circumferential edge portion is projected downward at a portion radially outside the stator; and an upper end of the stator is arranged at a level lower than that of an upper end of the rotor magnet, the base portion of the impeller is arranged axially above the rotor magnet and is arranged to extend radially outward, and the blades are arranged axially above the stator such that the upper end of the stator is directly exposed to an air inlet through the blades, the housing includes:

a lower plate arranged to cover a lower side of the impeller; and a side wall portion arranged to cover a lateral side of the impeller; and an upper plate having the air inlet, the upper plate arranged to cover an upper side of the circumferential edge portion of the impeller, wherein the base portion is exposed though the air inlet;

the upper plate, the side wall portion, and the lower plate are arranged to together define an air channel portion radially outside the circumferential edge portion of the impeller;

the upper plate, the side wall portion, and the lower plate are arranged to together define an air outlet provided radially outside the circumferential edge portion of the impeller, such that air is inhaled from the air inlet, flows in the radial direction inside the housing, and exhausted from the air outlet in the radial direction, an axial distance between an upper end edge of the air inlet and an upper end of each blade is arranged to be longer than an axial distance between a lower end of each blade and the stator, wherein the stator includes:

an annular core back;

a plurality of teeth arranged to extend radially inward from the core back; and coils wound on the teeth; and wherein an inner circumferential surface of the core back is arranged radially outward of all of the rotor hub portion and a base portion of each blade.

2. The blower fan according to claim 1, wherein the rotor hub portion and the impeller are defined by separate members;

the rotor hub portion includes:

an outer circumferential surface arranged to hold the rotor magnet; and a raised portion arranged to project radially outward from the outer circumferential surface, and including a lower surface arranged to be in contact with the rotor magnet; and a lower end of each blade is arranged at a level lower than that of an upper surface of the raised portion.

3. The blower fan according to claim 1, wherein the stator holding portion includes a projecting portion arranged to project axially upward radially outside the stator; and the stator is held by an inner surface of the projecting portion, and the projecting portion is arranged at a level lower than that of an uppermost end of the stator.

4. The blower fan according to claim 1, wherein at least a portion of the stator is arranged radially outward of all of the rotor hub portion and a base portion of each blade;

an axial gap between the stator and axially lower edges of the blades is, at a same radial position as that of the axial gap, joined to a space axially above axially upper edges of the blades through spaces defined circumferentially between the blades; and the axially lower edges of the blades are opposed to upper surfaces of an entire circumferential region of the coils with only the axial gap and without any other object intervening therebetween.

5. The blower fan according to claim 1, wherein a radially outer edge of each coil is arranged radially outward of all of the rotor hub portion and the base portion of each blade.

6. The blower fan according to claim 1, wherein a radially outer edge of each blade is arranged radially outward of the stator;

the stationary portion includes an outside gap arranged radially outside the stator to surround the stator.

7. The blower fan according to claim 1, wherein the stator includes a molding resin arranged between adjacent ones of the coils.

8. The blower fan according to claim 2, wherein an outer end of the raised portion is arranged radially inward of an outer circumferential surface of the rotor magnet; and the impeller is located radially outside the raised portion and axially above the rotor magnet.

9. The blower fan according to claim 6, wherein a lower end of each blade is arranged at a level lower than that of the upper end of the stator.

10. The blower fan according to claim 9, wherein the upper end of the stator is opposed to each blade, wherein a lower end of each blade is provided on the circumferential edge portion and is arranged at a level lower than that of the upper end of the stator.

* * * * *